US007165835B2

(12) United States Patent
Ota et al.

(10) Patent No.: US 7,165,835 B2
(45) Date of Patent: Jan. 23, 2007

(54) INK CARTRIDGE AND METHOD OF INK INJECTION THEREINTO

(75) Inventors: Mutsuhiko Ota, Nagano (JP); Yukiharu Suda, Nagano (JP); Hisashi Koike, Nagano (JP); Satoshi Shinada, Nagano (JP); Michinari Tsukahara, Nagano (JP); Hisashi Miyazawa, Nagano (JP); Yasuto Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 27 days.

(21) Appl. No.: 10/147,301

(22) Filed: May 17, 2002

(65) Prior Publication Data

US 2002/0171721 A1 Nov. 21, 2002

(30) Foreign Application Priority Data

May 17, 2001 (JP) ..... P2001-148296
Aug. 30, 2001 (JP) ..... P2001-262037

(51) Int. Cl.
*B41J 2/175* (2006.01)

(52) U.S. Cl. ..... 347/86; 347/85

(58) Field of Classification Search ..... 347/85, 347/86, 87

See application file for complete search history.

(56) References Cited

U.S. PATENT DOCUMENTS 4,968,998 A 11/1990 Allen
5,040,002 A * 8/1991 Pollacek et al. ..... 347/87
5,138,332 A * 8/1992 Carlotta ..... 347/92
5,581,287 A 12/1996 Baezner et al.
5,790,157 A * 8/1998 Higuma et al. ..... 347/85
5,898,450 A 4/1999 Ahn
5,903,294 A 5/1999 Abe et al.
6,022,102 A * 2/2000 Ikkatai et al. ..... 347/85
6,095,643 A * 8/2000 Cook et al. ..... 347/87
6,135,590 A * 10/2000 Saeki et al. ..... 347/86
6,474,796 B1 11/2002 Ishinaga

FOREIGN PATENT DOCUMENTS

EP 0 803 364 A2 10/1997
JP U-61-20332 2/1986
JP 07-266575 10/1995
JP 10-217500 8/1998

* cited by examiner

*Primary Examiner*—Anh T. N. Vo
(74) *Attorney, Agent, or Firm*—Sughrue Mion, PLLC

(57) ABSTRACT

An ink cartridge 1 is detachably connected to a head of a record apparatus and has a container main body 2 having an ink tank chamber 11 opened to the atmosphere in a state in which the head and the cartridge are connected and a first opening 85 through which ink can be injected into the ink tank chamber (second ink storage chamber 16, etc.,). Such an intermediate wall 301 partitioning the ink tank chamber 11 into two space parts 11*a* and 11*b* placed side by side in an ink injection direction is disposed in the ink tank chamber 11 and is formed with a through part 301*a* through which ink can be injected.

14 Claims, 11 Drawing Sheets

INK CARTRIDGE AND METHOD OF INK INJECTION THEREINTO

BACKGROUND OF THE INVENTION

This invention relates to an ink cartridge for supplying ink to a head of a record apparatus and a method of ink injection thereinto.

An ink jet record apparatus generally comprises a record head mounted on a carriage and moving in the width direction of record paper, and paper feed means for moving the record paper relatively in a direction orthogonal to the move direction of the record head.

Such an ink jet record apparatus prints on record paper by ejecting ink droplets from a record head based on print data.

A record head capable of ejecting black ink, yellow ink, cyan ink, and magenta ink, for example, is mounted on a carriage and in addition to text print in black ink, full-color print is made possible by changing the ink ejection percentage.

Thus, ink cartridges for supplying black ink, yellow ink, cyan ink, and magenta ink to the record head are placed in the main unit of the apparatus.

In the ordinary ink jet record apparatus, the ink cartridges for supplying black ink, yellow ink, cyan ink, and magenta ink are mounted on a carriage and are moved together with the carriage.

In the recent record apparatus, the carriage has been moved at high speed for the purpose of increasing the record speed.

In such a record apparatus, pressure fluctuation occurs in internal ink as an ink supply tube is extended and bent with acceleration and deceleration of the carriage, making unstable ejecting of ink droplets from the record head.

Thus, such an ink cartridge is proposed, that comprises a lower ink storage chamber (ink tank chamber) opened to the atmosphere side, an upper ink storage chamber (ink end chamber) for head connection, connected via an ink flow passage to the lower ink storage chamber, and a differential pressure regulating valve placed at midpoint in a passage connecting the upper ink storage chamber and a head supply port.

According to the ink cartridge, a negative pressure is generated on the head side by negative pressure generation means and the differential pressure regulating valve is opened accordingly for supplying ink to the record head, so that the adverse effect on ink produced by pressure fluctuation mentioned above is lessened and ink can be supplied to the record head at the optimum water head difference.

By the way, to inject ink into such an ink cartridge, the tip of an ink injector is positioned at an opening that is made in the outer surface of the ink cartridge (case) and that communicates with an ink tank chamber. Thus, in the beginning of injecting ink, the distance between the ink injection position (opening) and the bottom of the ink tank chamber is large, and also, after ink is injected (after the ink liquid level rises), there is a height difference between the ink injection position and the ink liquid level.

Thus, when ink is injected, air is easily mixed into the ink and there is a problem of bubbles occurring in the ink tank chamber.

It is therefore an object of the invention to provide an ink cartridge and a method of ink injection thereinto for making it possible to avoid air mixing into ink at the ink injection time and therefore prevent bubbles from occurring in an ink tank chamber.

SUMMARY OF THE INVENTION

To the end, according to the invention, there is provided an ink cartridge being detachably connected to a head of a record apparatus and comprising a case having an ink tank chamber opened to the atmosphere in a state in which the head and the cartridge are connected, and an opening through which ink can be injected into the ink tank chamber. The ink cartridge further comprises an intermediate wall partitioning the ink tank chamber into two space parts placed side by side in an ink injection direction. The intermediate wall is disposed in the ink tank chamber, and is formed with a through part through which ink can be injected.

Since the ink cartridge is thus configured, ink injection can be conducted at a deeper position than the opening of the case (in the vicinity of the through part). In this case, in the beginning of injecting ink, the distance between the ink injection position and the bottom of the ink tank chamber is small and thus air entraining is small and ink bubbles are less produced. If the ink liquid level rises and is higher than the intermediate wall, air entraining does not occur and ink bubbles are suppressed.

Therefore, it is possible to prevent air from mixing into ink at the ink injection time, and bubbles from occurring in the ink tank chamber.

Here, it is desirable that an atmospheric communication port for discharging air in the ink tank chamber as ink is injected is provided on the same side as the formation position of the opening.

Since the ink cartridge is thus configured, ink is injected into the ink tank chamber while air is discharged from the atmospheric communication port.

It is desirable that the through part is disposed on the axis of the opening.

Since the ink cartridge is thus configured, to inject ink into the ink tank chamber with an ink injection machine (ink injector), the injection part (tip) of the ink injector can be inserted into the opening of the case and positioned at the through part.

Further, it is desirable that the through part is formed so as to permit the tip of the ink injector to be inserted and passed through the through part into the deeper space part.

Since the ink cartridge is thus configured, in the ink tank chamber, the tip of the ink injector can be inserted into the opening of the case and further positioned at the deeper space part for reliably injecting ink.

It is desirable that the through part is a through hole circular in cross section or a through hole U-shaped shaped in cross section.

On the other hand, according to the invention, there is provided a method of injecting ink into an ink cartridge being detachably connected to a head of a record apparatus and comprising: a case having an ink tank chamber opened to atmosphere in a state in which the head and the cartridge are connected, and an opening through which ink can be injected into the ink tank chamber; and an intermediate wall having a through part, being disposed in the case, and partitioning the ink tank chamber into two space parts placed side by side in an ink injection direction. In the ink injection method, ink is injected through the through part into deeper one of the space parts relative to the opening.

According to this method, ink injection can be conducted at a deeper position than the opening of the case (in the vicinity of the through part) in the ink tank chamber.

Therefore, it is possible to obtain an ink cartridge that prevents air from mixing into ink at the ink injection time and bubbles from occurring in the ink tank chamber.

It is desirable that the through part is a through hole circular in cross section or a through hole U-shaped in cross section.

Here, it is desirable that to inject ink, the tip of the ink injector is inserted into the through part and is positioned at the deeper space part of both the space parts.

According to this method, when ink is injected, in the ink tank chamber, the tip of the ink injector can be inserted into the opening of the case and further positioned at the deep space part for reliably injecting ink.

It is desirable that ink is injected while air in the ink tank chamber is discharged.

According to this method, ink can be smoothly injected into the ink tank chamber.

The present disclosure relates to the subject matter contained in Japanese patent application No. 2001-148296 (filed on May 17, 2001) and 2001-262037 (filed on Aug. 30, 2001, which are expressly incorporated herein by reference in their entireties.

DESCRIPTION OF THE PREFERRED EMBODIMENT

Referring now to the accompanying drawings, there are shown preferred embodiments of an ink cartridge and an ink injection method thereinto incorporating the invention.

Figure 1:
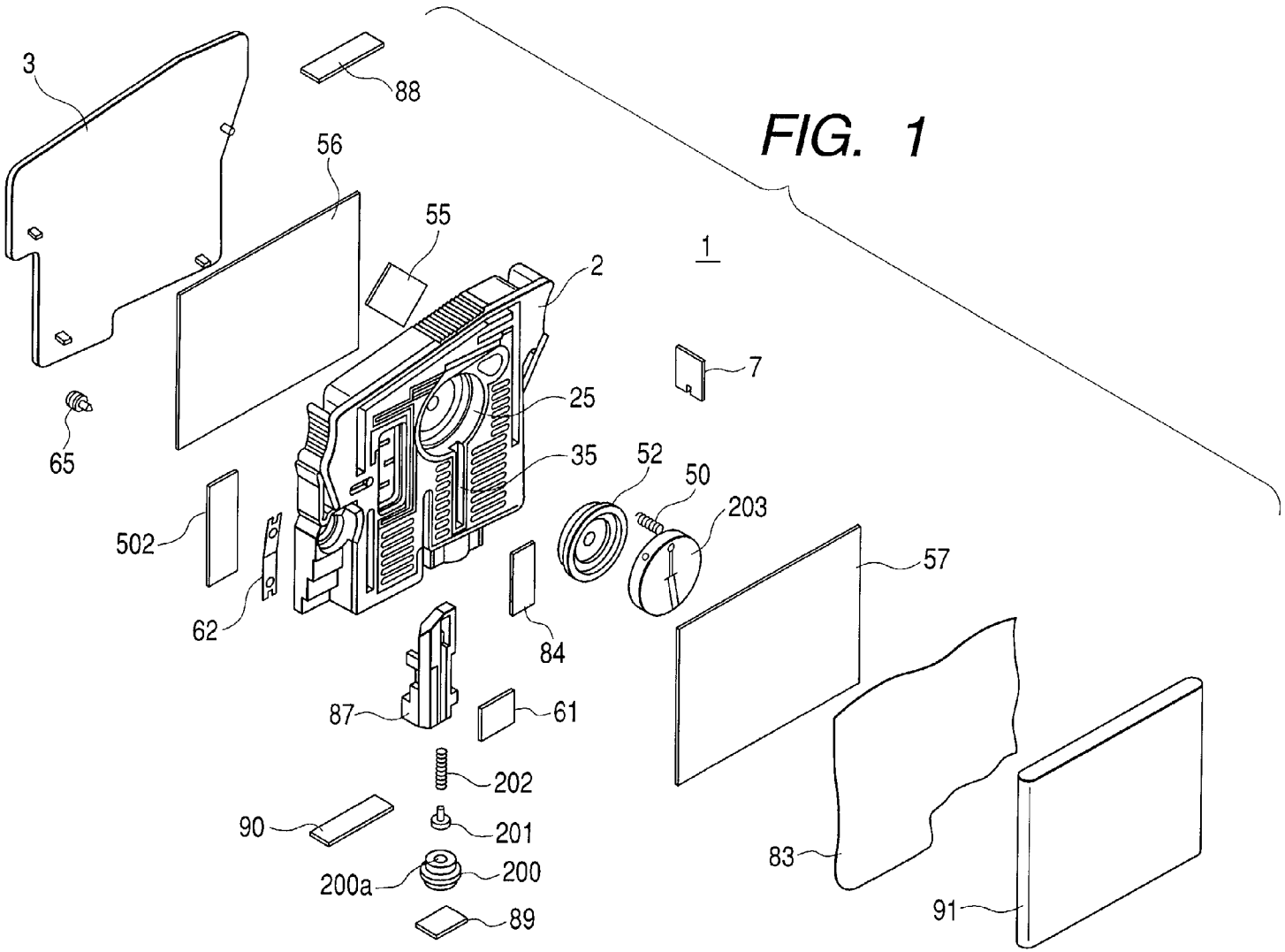
FIG. 1 is an exploded perspective view to show the whole of the ink cartridge according to an embodiment of the invention.
Figure 2A:
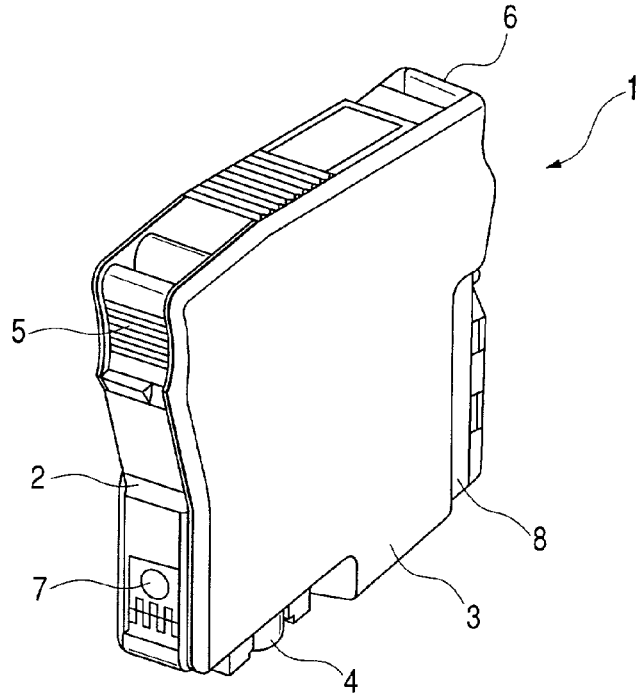
FIGS. 2(*a*) and 2(*b*) are perspective views to show the appearance of the ink cartridge according to the embodiment of the invention.
Figure 2B:
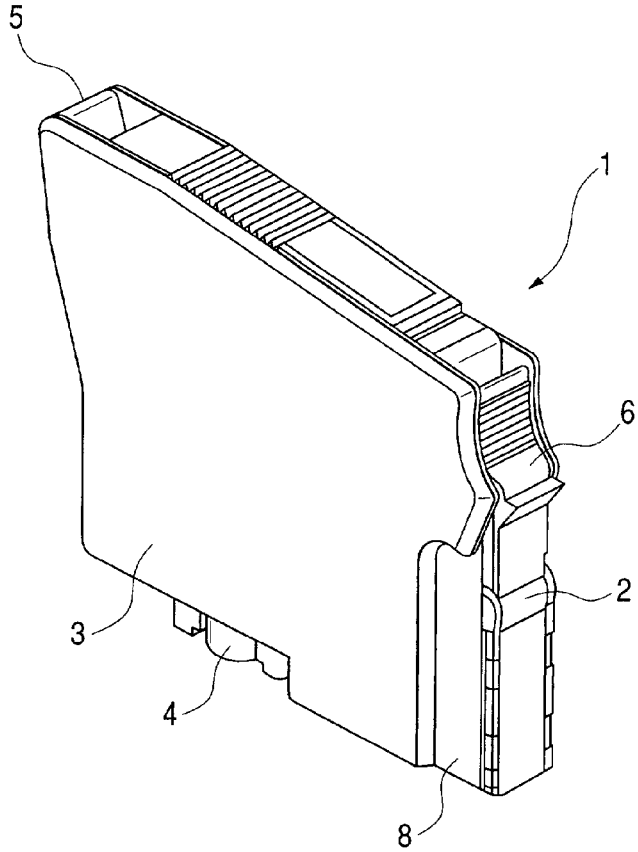
Figure 3:
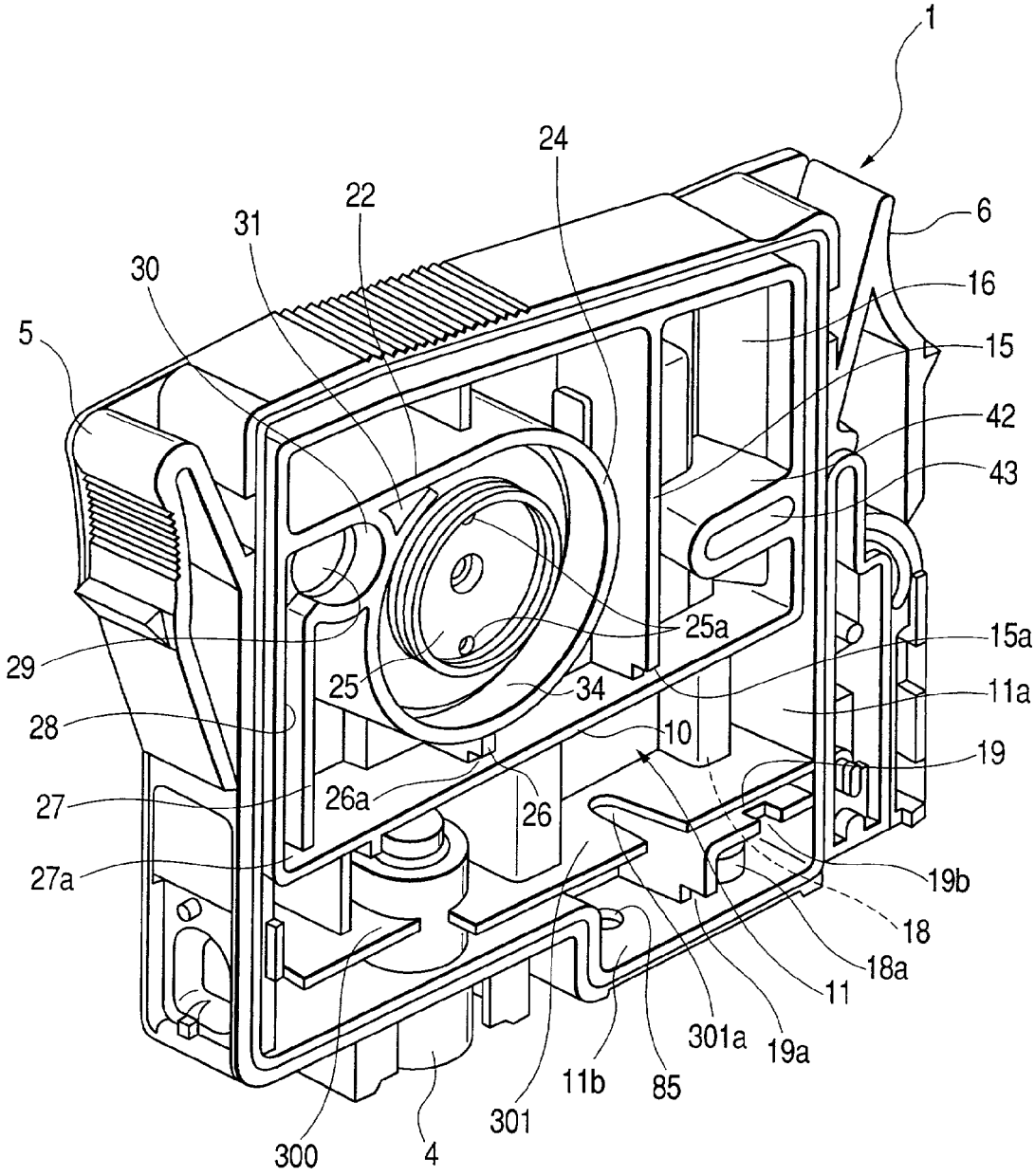
FIG. 3 is a perspective view showing the internal structure of the ink cartridge according to the embodiment of the invention as viewed from upward in a slanting direction.
Figure 4:
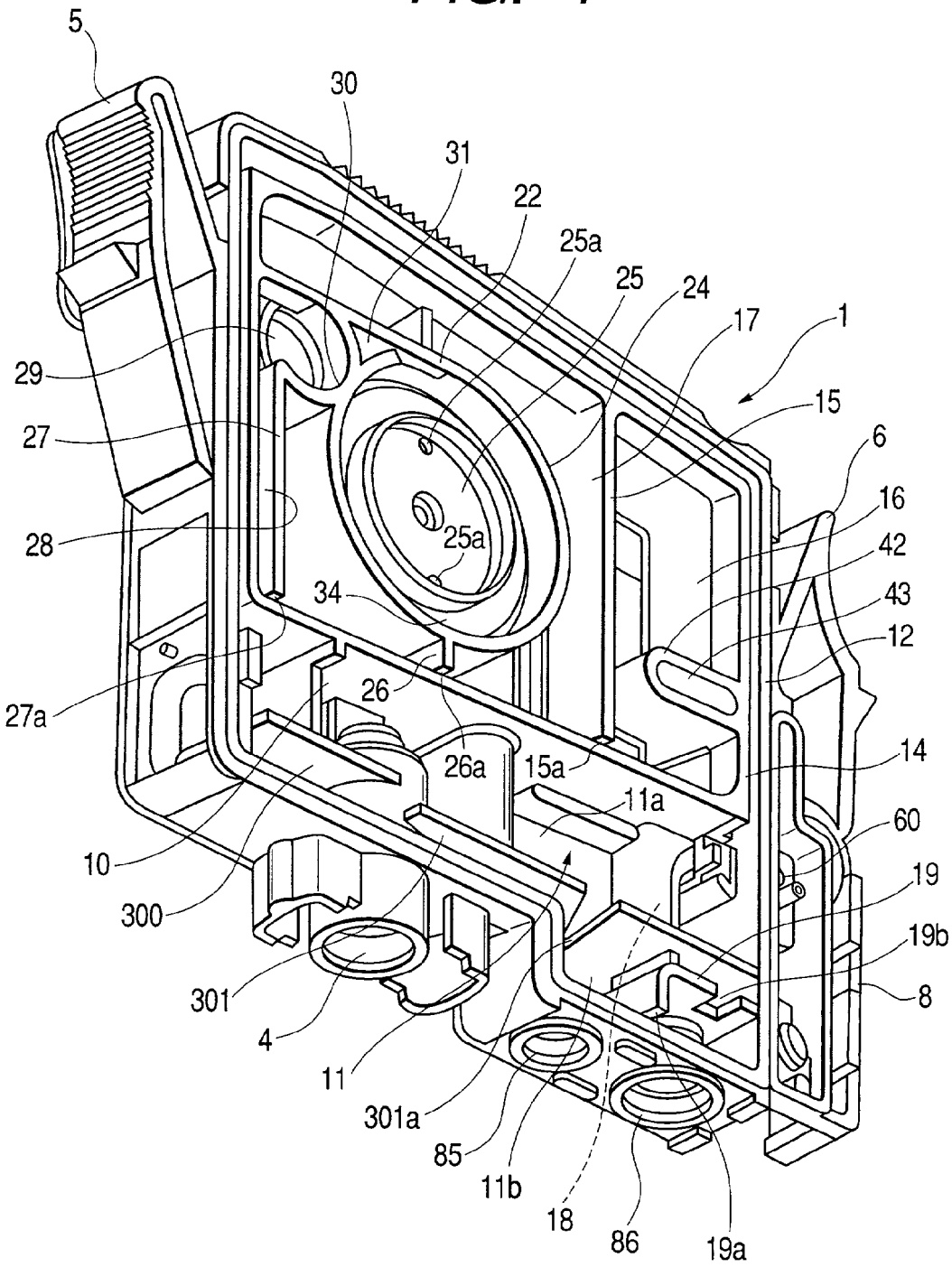
FIG. 4 is a perspective view showing the internal structure of the ink cartridge according to the embodiment of the invention as viewed from downward in a slanting direction.
Figure 5:
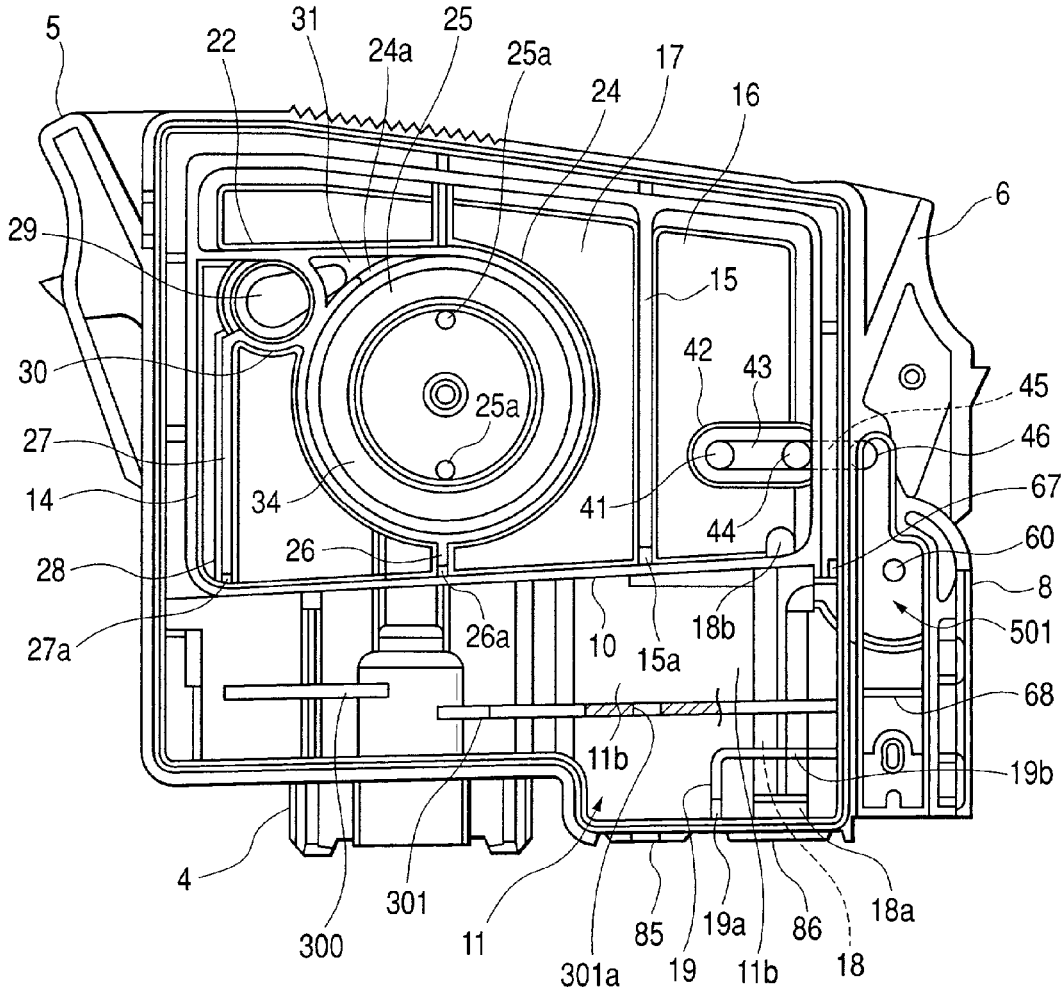
FIG. 5 is a front view to show the internal structure of the ink cartridge according to the embodiment of the invention.
Figure 6:
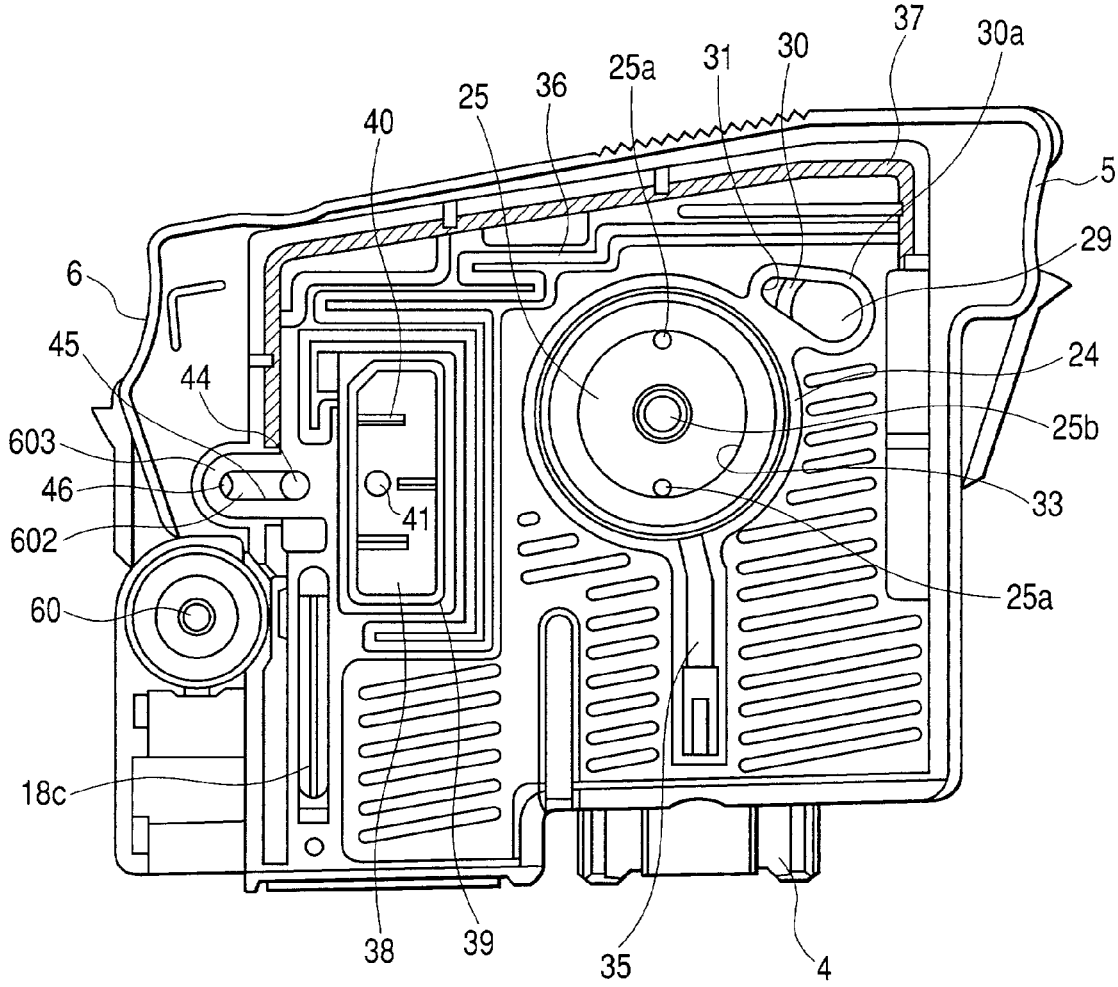
FIG. 6 is a rear view to show the internal structure of the ink cartridge according to the embodiment of the invention.
Figure 7:
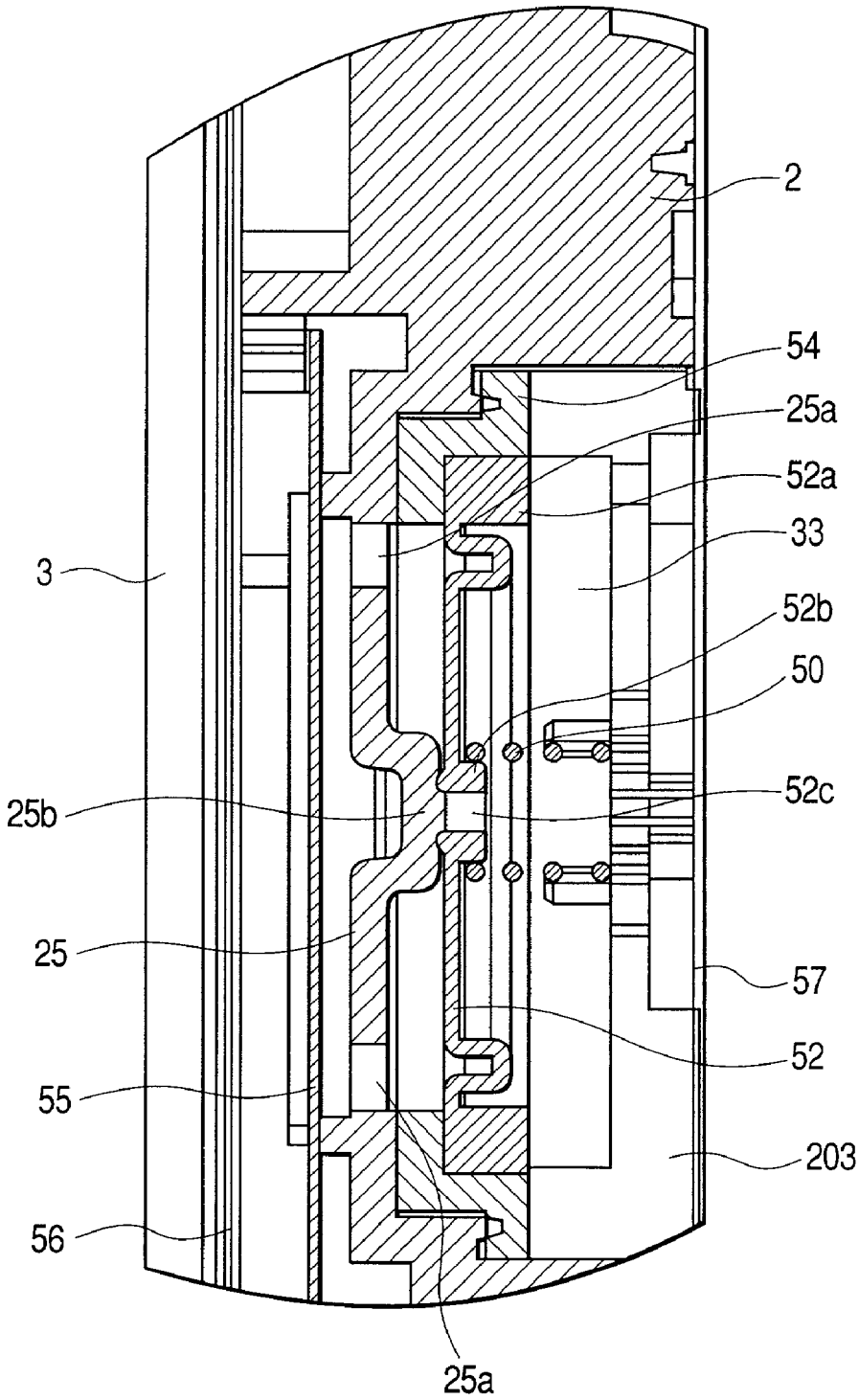
FIG. 7 is an enlarged sectional view to show a negative pressure generation system storage chamber of the ink cartridge according to the embodiment of the invention.
Figure 8:
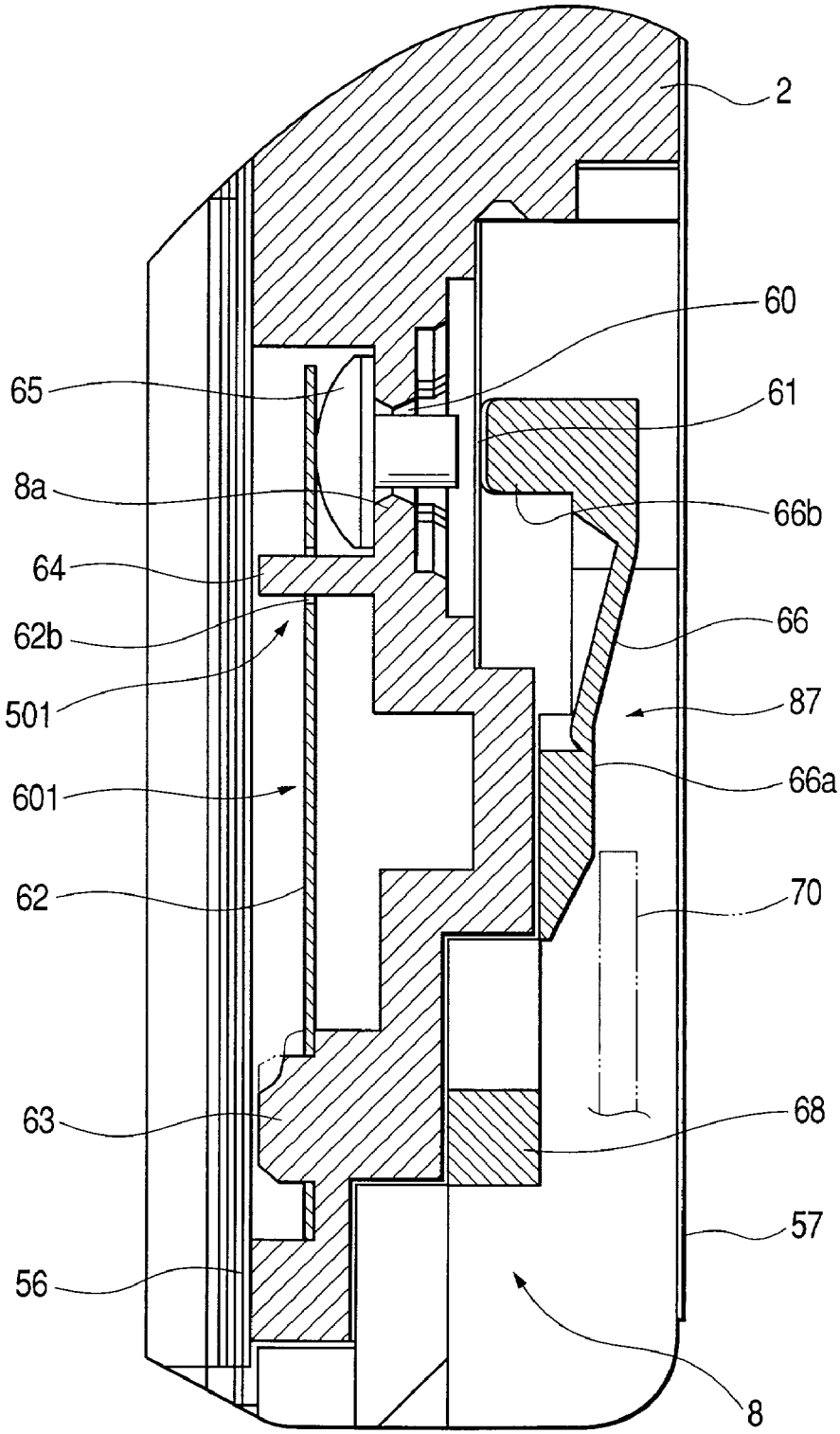
FIG. 8 is an enlarged sectional view to show a valve storage chamber of the ink cartridge according to the embodiment of the invention.
Figure 9:
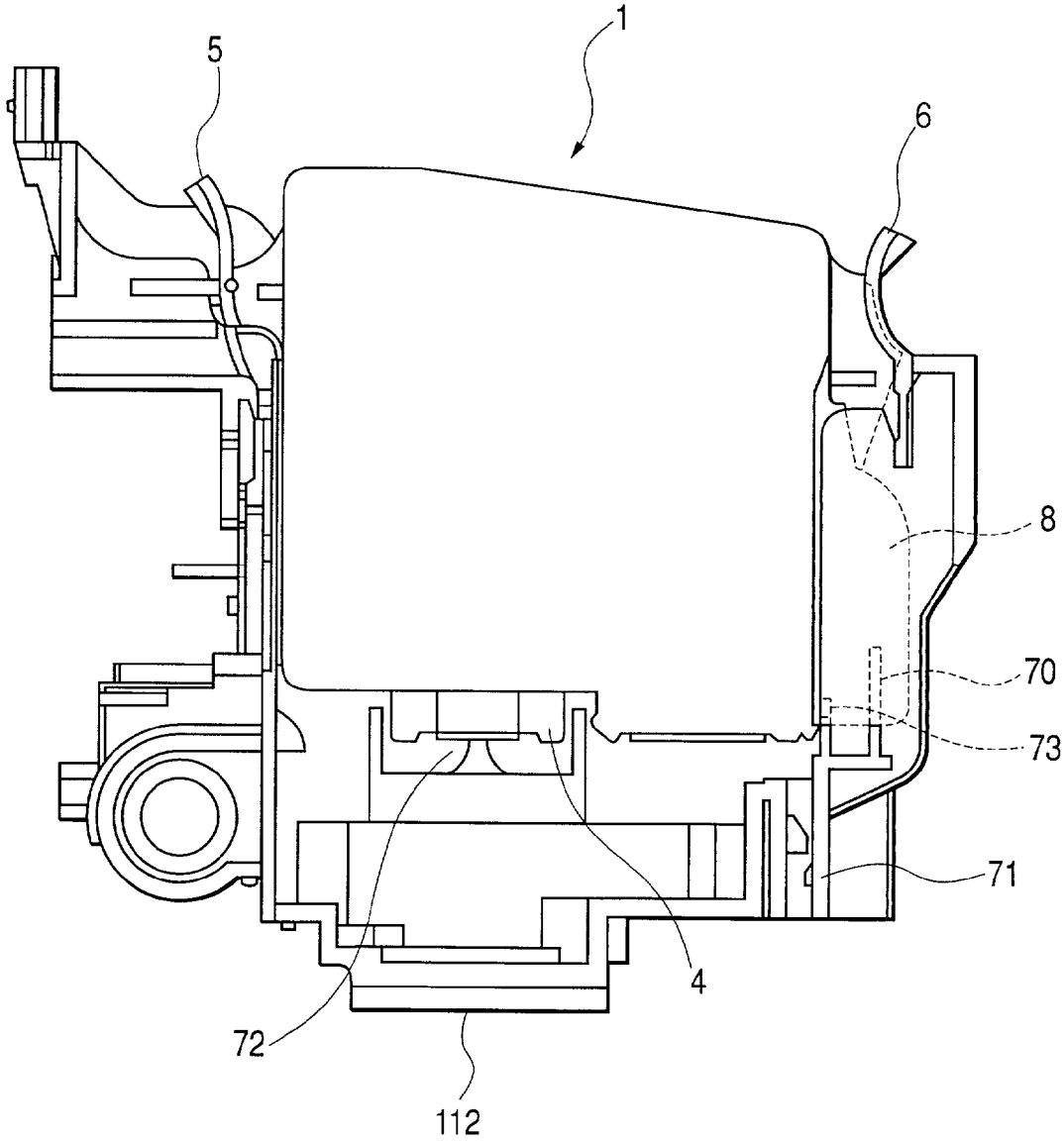
FIG. 9 is a front view to show the connection state of the ink cartridge according to the embodiment of the invention to a cartridge holder.
Figure 10B:
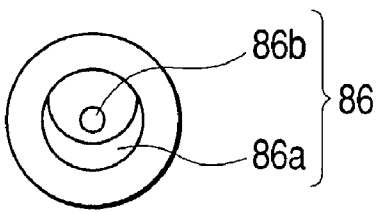
FIGS. 10(*a*) and 10(*b*) are views to describe an ink injection flow passage of the ink cartridge according to the embodiment of the invention, in which FIG. 10(*a*) is a sectional view to schematically show the internal structure of the ink cartridge, and FIG. 10(*b*) is a bottom view to show an ink injection hole.
Figure 10A:
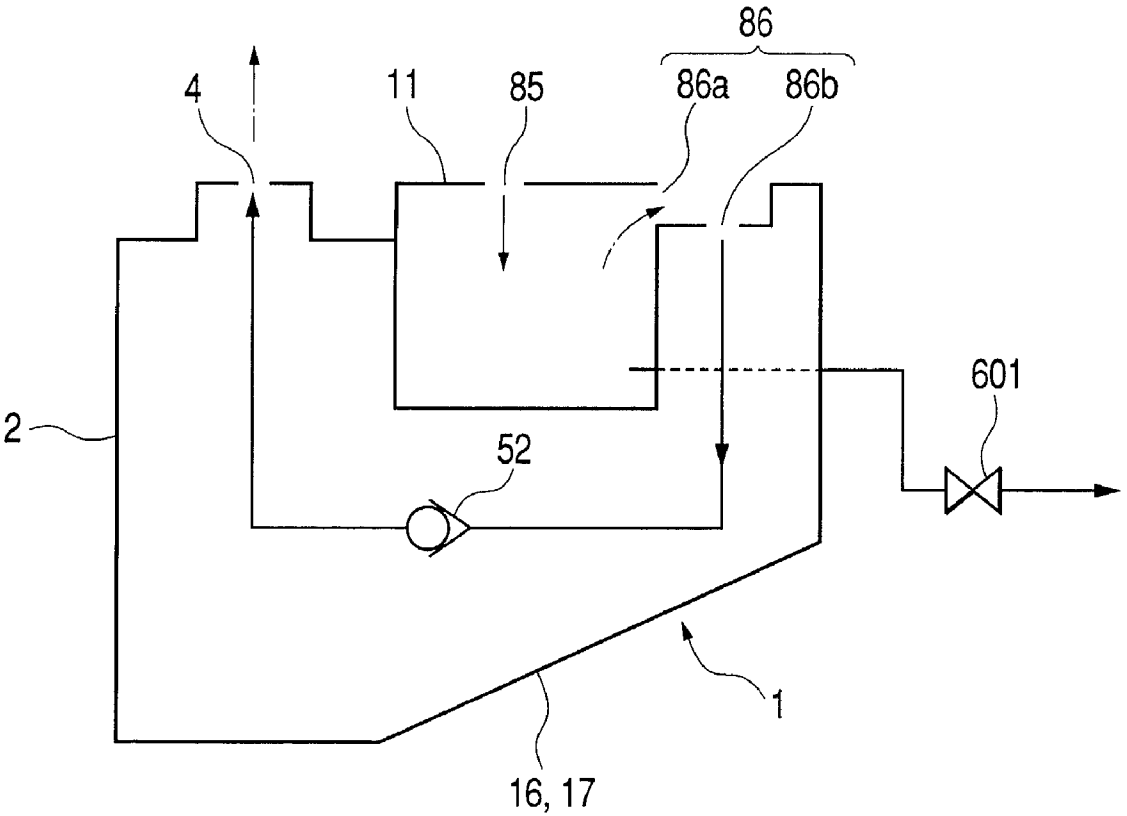

To begin with, the ink cartridge will be discussed with reference to FIGS. 1 to 10, FIG. 1 is an exploded perspective view to show the whole of the ink cartridge according to the embodiment of the invention. FIGS. 2(*a*) and 2(*b*) are perspective views to show the appearance of the ink cartridge according to the embodiment of the invention. FIGS. 3 and 4 are perspective views showing the internal structure of the ink cartridge according to the embodiment of the invention as viewed from upward and downward in a slanting direction. FIGS. 5 and 6 are a front view and a rear view to show the internal structure of the ink cartridge according to the embodiment of the invention. FIGS. 7 and 8 are enlarged sectional views to show a negative pressure generation system storage chamber and a valve storage chamber of the ink cartridge according to the embodiment of the invention. FIG. 9 is a front view to show the connection state of the ink cartridge according to the embodiment of the invention to a cartridge holder. FIGS. 10(*a*) and 10(*b*) are views to describe an ink injection flow passage of the ink cartridge according to the embodiment of the invention, in which FIG. 10(*a*) is a sectional view to schematically show the internal structure of the ink cartridge, and FIG. 10(*b*) is a bottom view to show an ink injection hole.

An ink cartridge 1 shown in FIGS. 2(*a*) and 2(*b*) has a container main body (lower case) 2 almost rectangular in a plane view, and opened to one side, and a lid body (upper case) 3 for sealing the opening of the container main body 2. The interior of the ink cartridge 1 is generally constructed to have an ink flow passage system and an air flow passage system (both described later).

Formed in the lower portion of the container main body 2 are an ink supply port 4 that can be connected to an ink supply needle 72 of a record head 112 (both are shown in FIG. 9), and a first opening (open hole) 85 and a second opening 86 (both are shown in FIGS. 4 and 5) placed side by side adjacent to the ink supply port 4. The ink supply port 4 is made to communicate with an ink end chamber (differential pressure regulating valve storage chamber) described later, and the first opening 85 is made to communicate with a first ink storage chamber (ink tank chamber) 11.

A substantially cylindrical seal member 200 made of rubber, etc., is placed in the ink supply port 4, as shown in FIG. 1.

A through hole 200*a* axially opened is made at the center of the seal member 200. A spring bracket (valve body) 201 for opening and closing the through hole 200*a* as the ink supply needle 72 is inserted and removed is disposed in the ink supply port 4, and further a helical compression spring 202 for urging the spring bracket 201 to the seal member 200 is placed.

The second opening 86 is made to communicate with the first ink storage chamber 11 through an atmospheric communication port 86*a*, and communicate with the ink end chamber (second ink storage to chamber 16, third ink storage chamber 17, etc.,) through an ink injection port 86*b*, as shown in FIGS. 10(*a*) and 10(*b*).

Retention members 5 and 6 that can be attached to and detached from a cartridge holder are provided integrally on the upper sides of the container main body 2. A circuit board (IC board) 7 is disposed below one retention member 5 as shown in FIG. 2 (*a*), and a valve storage chamber 8 is disposed below the other retention member 6 as shown in FIGS. 2(*a*) and 2(*b*).

The circuit board 7 has a storage device retaining information data concerning ink, for example, color type, pigment/dye based ink type, ink remaining amount, serial number, expiration date, applied model, and the like so that the data can be written.

The valve storage chamber 8 has an internal space opened to the cartridge insertion side (lower side) as shown in FIG. 8, and an identification piece(s) 73 and a valve operation rod 70 (shown in FIG. 9) on the record apparatus matching with the ink cartridge 1 advance and retreat in the internal space. An operation arm 66 of an identification block 87, which is rotated as the valve operation rod 70 advances and retreats, is housed in the upper part of the internal space. An identification convex part(s) 68 for determining whether or not the ink cartridge matches with a given record apparatus is formed in the lower part of the internal space. The identification convex part 68 is placed at a position for making possible a determination by the valve operation rod 70 (the identification piece 73) of a cartridge holder 71 (shown in FIG. 9) before the ink supply needle 72 (shown in FIG. 9) on the record apparatus is made to communicate with the ink supply port 4 (before an atmospheric open valve described later is opened).

A through hole 60 as an atmospheric communication hole opened and closed by the opening and closing operation of an atmospheric open valve 601 is made in a chamber wall 8*a* of the valve storage chamber 8 (atmospheric open chamber 501), as shown in FIG. 8. The operation arm 66 is placed on one opening side of the through hole 60, and the atmospheric open valve 601 is placed on the other opening side of the through hole 60. The operation arm 66 has an operation part 66*b* for pressing a pressurization film (elastically deformable film) 61, and is placed projecting in an upward slanting direction into the path of the valve operation rod 70 and is fixed to the container main body 2 through a rotation supporting point 66*a*.

The pressurization film 61 is attached to the chamber wall 8*a* so as to block the through hole 60, and the whole of the pressurization film 61 is formed of an elastic seal member of rubber, etc. The internal space formed between the pressurization film 61 and the opening peripheral margin of the through hole 60 is opened to a through hole 67 communicating with the first ink storage chamber (ink tank chamber) 11 (both are shown in FIG. 5).

The atmospheric open valve 601 has a valve body 65 for opening and closing the through hole 60, and an elastic member (plate spring) 62 for constantly urging the valve body 65 against the opening peripheral margin of the through hole 60. The elastic member 62 is formed at an upper end part with a through hole 62*b* into which a projection 64 is inserted for regulating the elastic member 62 in move (guiding). On the other hand, the elastic member 62 is fixed at a lower end part onto the container main body 2 through a projection 63.

In FIG. 1, numeral 88 denotes an identification label put on an upper face part of the container main body 2 corresponding to the block 87, numeral 89 denotes a film for sealing the ink supply port 4 (through hole 200*a*), and numeral 90 denotes a film for sealing the first opening 85 and the second opening 86. Numeral 91 denotes a vacuum pack for wrapping the ink cartridge 1 already filled with ink.

Next, the ink flow passage system and the air flow passage system in the container main body 2 will be discussed with reference to FIGS. 1 to 10.

[Ink Flow Passage System]

The ink cartridge 1 is formed with an internal space by joining the lid body 3 to the front of the container main body 2 through inner films (air shield films) 56 and 502 and joining a protective label 83 to the rear of the container main body 2 through an outer film (air shield film) 57, as shown in FIG. 1. The internal space is divided into upper and lower parts by a partition wall 10 extending slightly downward toward the ink supply port side opposed to the record head 112 (shown in FIG. 9), as shown in FIGS. 3 to 5. The lower area of the internal space provides the first ink storage chamber 11 opened to the atmosphere in the connection state to the record head 112.

Two intermediate walls 300 and 301 different in height position are disposed in the first ink storage chamber 11. One intermediate wall 300 is placed with a predetermined spacing from one side surface part of the first ink storage chamber 11. The other intermediate wall 301 is opposed to the bottom part of the first ink storage chamber 11 and is placed on the ink supply port side of the intermediate wall 300. The intermediate wall 301 partitions the first ink storage chamber 11 into two space parts 11*a* and 11*b* placed side by side in the ink injection direction (up and down). The intermediate wall 301 is formed with a through part 301*a* having the same axis as the axis of the first opening 85. The through part 301*a* is formed as an opening (notch) for allowing the nozzle tip of an ink injection machine (ink injector) described later to be inserted thereinto and positioned at the deep space part 11*a* of both the space parts 11*a* and 11*b*.

The through part is not limited to the through hole shaped like a letter U in cross section shown in the figure, and may be a through hole circular in cross section.

On the other hand, the upper area of the internal space is defined by a frame 14 with the partition wall 10 as a bottom part. The internal space of the frame 14 forms (a part of) the ink end chamber connected to the record head 112, and the front side of the ink end chamber is divided into left and right parts by a vertical wall 15 having a communication port 15*a*. One of the areas into which the internal space is divided provides a second ink storage chamber 16, and the other area provides a third ink storage chamber 17.

A communication flow passage 18 communicating with the first ink storage chamber 11 is connected to the second ink storage chamber 16. The communication flow passage 18 has communication ports 18*a* and 18*b* at lower and upper positions. The communication flow passage 18 is formed by a recess part 18*c* (shown in FIG. 6) opened to the rear of the container main body 2 and extending in the up and down direction and an air shield film (outer film 57) for blocking and sealing the opening of the recess part 18*c*. A partition wall 19 having two lower and upper communication ports 19*a* and 19*b* communicating with the inside of the first ink storage chamber 11 is provided upstream from the communication flow passage 18. One communication port 19*a* is placed at a position opened to the lower area in the first ink storage chamber 11. The other communication port 19*b* is placed at a position opened to the upper area in the first ink storage chamber 11.

On the other hand, the third ink storage chamber 17 is formed with a differential pressure regulating valve storage chamber 33 (shown in FIG. 6) for storing a differential pressure regulating valve 52 (membrane valve) shown in FIG. 7 and a filter chamber 34 (shown in FIG. 5) for storing a filter 55 (nonwoven fabric filter) shown in FIG. 7 by a laterally elongating partition wall 22 and an annular partition wall 24. The partition wall 25 is formed with through holes 25*a* for introducing ink passed through the filter 55 into the differential pressure regulating valve storage chamber 33 from the filter chamber 34.

The partition wall 24 is formed at a lower part with a partition wall 26 having a communication port 26*a* between the partition wall 24 and the partition wall 10, and is formed on a side with a partition wall 27 having a communication port 27*a* between the partition wall 24 and the frame 14. A communication passage 28 communicating with the communication port 27*a* and extended in the up and down direction is provided between the partition wall 27 and the frame 14. A through hole 29 communicating with the filter chamber 34 through the communication port 24*a* and an area 31 is placed in an upper part of the communication passage 28.

The through hole 29 is formed by a partition wall (annular wall) 30 continuous to the partition wall 27.

The area 31 is formed by the partition walls 22, 24, and 30 and a partition wall 30*a* (shown in FIG. 6). The area 31 is formed deep at one end part of the container main body 2 (portion communicating with the through hole 29) and shallow at an opposite end part (portion communicating with the filter chamber 34).

The differential pressure regulating valve storage chamber 33 stores the membrane valve 52 as a differential pressure regulating valve that can become elastically deformed, such as an elastomer, as shown in FIG. 7. The membrane valve 52 has a through hole 52*c*, and is urged to the filter chamber side by a helical compression spring 50, and has an outer peripheral margin fixed through an annular thick part 52*a* to the container main body 2 by ultra sonic welding. The helical compression spring 50 is supported at one end part by a spring bracket 52*b* of the membrane valve 52 and at an opposite end part by a spring bracket 203 in the differential pressure regulating valve storage chamber 33. The position accuracy of the helical compression spring 50 to the membrane valve 52 is an important element for the differential pressure regulating valve to control the differential pressure, and the convex part of the membrane valve 52 needs to be placed by the helical compression spring 50 without bend, position shift, etc., as shown in FIG. 7.

Numeral 54 denotes a frame formed integrally with the thick part 52*a* of the membrane valve 52.

The filter 55 for allowing ink to pass through and capturing dust, etc., is placed in the filter chamber 34, as shown FIG. 7. The opening of the filter chamber 34 is sealed with the inner film 56 and the opening of the differential pressure regulating valve storage chamber 33 is sealed with the outer film 57, When the pressure in the ink supply port 4 lowers, the membrane valve 52 is separated from a valve seat part 25*b* against the urging force of the helical compression spring 50 (the through hole 52*c* is opened). Thus, ink passed through the filter 55 passes through the through hole 52*c* and flows into the ink supply port 4 through the flow passage formed by the recess part 35. When the ink pressure in the ink supply port 4 rises to a predetermined value, the membrane valve 52 sits on the valve seat part 25*b* by the urging force of the helical compression spring 50, shutting off the flow of ink. Such operation is repeated, whereby ink is supplied to the ink supply port 4 while a constant negative pressure is maintained.

[Air Flow Passage System]

As shown in FIG. 6, the container main body 2 is formed on the rear with a meander groove 36 for raising flow passage resistance, and a wide concave groove 37 (hatched portion) opened to the atmosphere, and further a recess part 38 (space part) having an almost rectangular shape in a plane view leading to the first ink storage chamber 11 (shown in FIG. 5). The recess part 38 contains a frame 39 and ribs 40, onto which an air permeable film 84 is stretched and fixed to thereby form an atmospheric ventilation chamber. A through hole 41 is made in the bottom part (wall part) of the recess part 38 and is made to communicate with an elongated area 43 defined by the partition wall 42 (shown in FIG. 5) of the second ink storage chamber 16. The area 43 has a through hole 44 and is made to communicate with the atmospheric open chamber 501 (shown in FIG. 8) through a communication groove 45 defined by a partition wall 603 and a through hole 46 opened to the communication groove 45. The opening of the atmospheric open chamber 501 is sealed with the inner film (air shield film) 502 shown in FIG. 1.

According to the configuration, when the ink cartridge 1 is mounted to the cartridge holder 71 as shown in FIG. 9, the valve operation rod 70 of the cartridge holder 71 abuts the operation arm 66 shown in FIG. 8 for moving the convex part 66*b* (pressurization film 61) to the valve body side. Accordingly, the valve body 65 is separated from the opening peripheral margin of the through hole 60, and the first ink storage chamber 11 shown in FIG. 5 is opened to the recess part 38 (atmosphere) shown in FIG. 6 through the through holes 67, 60, and 46, the groove 45, the through hole 44, the area 43, the through hole 41, etc. The valve body 201 in the ink supply port 4 is opened by insertion of the ink supply needles 72.

As the valve body 201 in the ink supply port 4 is opened and ink is consumed by the record head 112, the pressure of the ink supply port 4 falls below a stipulated value. Thus, the membrane valve 52 in the differential pressure regulating valve storage chamber 33 shown in FIG. 7 is opened (if the pressure of the ink supply port 4 rises above the stipulated value, the membrane valve 52 is closed), ink in the differential pressure regulating valve storage chamber 33 flows into the record head 112 through the ink supply port 4.

Further, as consumption or ink in the record head 112 proceeds, ink in the first ink storage chamber 11 flows into the second ink storage chamber 16 through the communication flow passage 18 shown in FIG. 4.

On the other hand, as ink is consumed, air flows in through the through hole 67 (shown in FIG. 5) communicating with the atmosphere, and the ink liquid level in the first ink storage chamber 11 lowers. As ink is further consumed and the ink liquid level reaches the communication port 19*a*, ink from the first ink storage chamber 11 (opened to the atmosphere through the through hole 67 at the ink supplying time) flows into the second ink storage chamber 16 via the communication flow passage 18 together with air. Since bubbles are moved up by a buoyant force, only the ink flows into the third ink storage chamber 17 through the communication port 15*a* in the lower part of the vertical wall 15, passes through the communication port 26*a* of the partition wall 26 from the third ink storage chamber 17, moves up on the communication passage 28, and flows into the upper part of the filter chamber 34 from the communication passage 28 through the area 31 and the communication port 24*a*.

After this, the ink in the filter chamber 34 passes through the filter 55 shown in FIG. 7, flows into the differential pressure regulating valve storage chamber 33 from the through holes 25*a*, further passes through the through hole 52*c* of the membrane valve 52 separated from the valve seat part 25*b* and then moves down in the recess part 35 shown in FIG. 6 and flows into the ink supply port 4.

The ink is thus supplied from the ink cartridge 1 to the record head 112.

If a different kind of ink cartridge 1 is placed in the cartridge holder 71, before the ink supply port 4 arrives at the ink supply needle 72, the identification convex part 68 (shown in FIG. 7) abuts the identification piece 73 (shown in FIG. 9) of the cartridge holder 71, blocking entry of the valve operation rod 70. Therefore, occurrence of trouble as a different kind of ink cartridge is placed can be prevented.

In this state, the valve operation rod 70 does not arrive at the operation arm 66 either and thus the valve body 65 is maintained in the closed valve state, preventing evaporation of the ink solvent in the first ink storage chamber 11 as it is left standing.

On the other hand, if the ink cartridge 1 is drawn out from the placement position in the cartridge holder 71, the operation arm 66 is elastically restored because it is no longer supported by the operation rod 70, and the valve body 65 is elastically restored accordingly, blocking the through hole 60, so that communication between the recess part 38 and the first ink storage chamber 11 is shut off.

Figure 11:
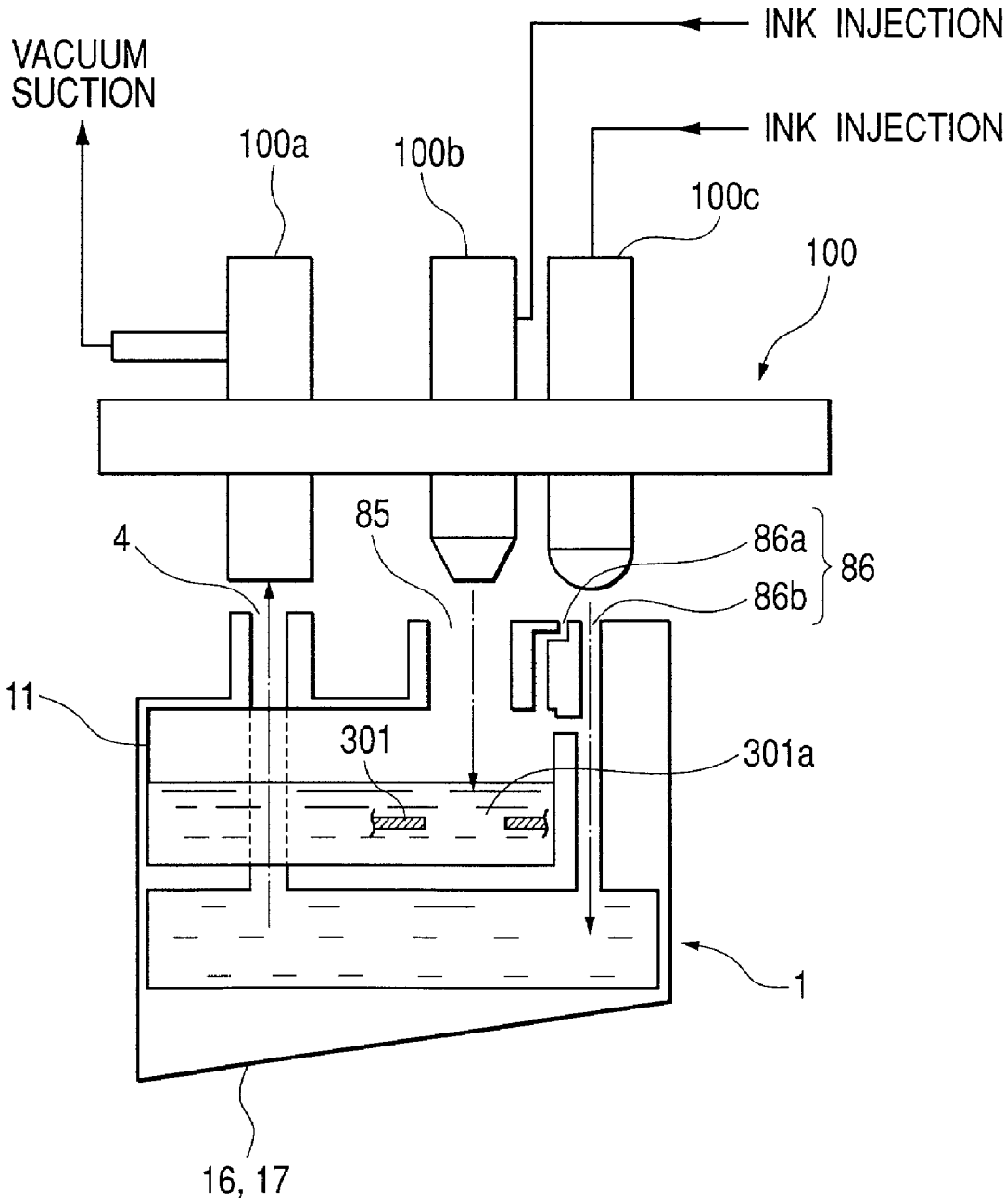
FIG. 11 is a schematic drawing to describe a method of ink injection into the ink cartridge according to the embodiment of the invention.

Next, a method of ink injection into the ink cartridge 1 according to the embodiment will be discussed with reference to FIGS. 5, 10, and 11. FIG. 11 is a schematic drawing to describe the ink injection method into the ink cartridge according to the embodiment.

The ink injection method into the ink cartridge in the embodiment is characterized by the fact that the position of ink injection into the ink tank chamber 11 is set to be deeper than the position of the first opening 85 in the ink tank chamber 11.

To this end, an ink injection machine 100 as shown in FIG. 11 is used. The ink injection machine 100 comprises a nozzle 100*b* for injecting ink into the ink tank chamber 11, a nozzle 100*c* for injecting ink into the ink end chamber (second ink storage chamber 16, third ink storage chamber 17, etc.,), and a nozzle 100*a* for performing vacuum suction to discharge air in the ink end chamber. The nozzle 100*a* is connected to the ink supply port 4, the nozzle 100*b* to the first opening 85, and the nozzle 100*c* to the second opening 86.

The nozzle 100*b* is inserted into and placed at a deeper position in the cartridge than the through part 301*a* of the intermediate wall 301 shown in FIGS. 3 to 5 and 11.

Thus, the nozzle 100*b* is inserted into and passed through the first opening 85 and the through part 301*a* so that the ink injection position is located deeper than the through part 301*a* (at a deep interior part of the cartridge), whereby when ink is injected, ink bubbles can be prevented from occurring. That is, in the beginning of injecting ink, the height difference between the ink injection port of the nozzle 100*b* and the ink liquid level is small and thus bubbles are less produced. When the ink liquid level rises as ink injection proceeds, the ink injection port of the nozzle 100*b* goes under the injected ink and air entraining does not occur, so that bubbles do not occur. Even if ink bubbles occur when ink is injected, the intermediate wall 301 prevents the bubbles from rising and ink bubbles do not occur between the intermediate wall 301 and the first opening 85.

Thus, if the ink cartridge 1 is turned upside down (is placed in the state shown in FIG. 5) after ink is injected, ink bubbles move to the top of the ink cartridge 1.

Consequently, ink with no bubbles can be supplied through the communication ports 19*a* and 19*b* to the communication flow passage 18 and finally can be supplied to the ink supply port 4.

When ink is supplied through the first opening 85 to the ink tank chamber 11 as indicated by the arrow (solid line) in FIG. 10, the atmosphere in the ink tank chamber 11 is escaped through the atmospheric communication port 86*a* as indicated by the arrow (dashed line) in FIG. 10, whereby it is made possible to supply ink from the nozzle 100*b*. That is, the ink tank chamber 11 communicates with the atmospheric open valve 601 through the through hole 67, but the atmospheric open valve 601 is closed with the ink cartridge 1 not placed in the cartridge holder 71. Thus, the atmospheric communication port 86*a* is provided for escaping the atmosphere (air) in the ink tank chamber 11 when ink is injected.

The atmospheric communication port 85*a*is opened facing the second opening 86 together with the ink injection port 86*b*. Thus, the second opening 86 is sealed with the film 90 after ink is injected, whereby the atmospheric communication port 86*a* and the ink injection port 86*b* can be hermetically sealed.

Next, ink injection into the ink end chamber through the nozzle 100*c* will be discussed with reference to FIG. 11.

The differential pressure regulating valve 52 is placed between the ink injection port 86*b* of the second opening 86, to which the nozzle 100*c* is connected, and the ink supply port 4. Thus, unless the pressure on the ink supply port 4 side is low, ink cannot be filled up to the ink supply port 4.

Air needs to be prevented from being mixed into the ink end chamber. Thus, vacuum suction is conducted through the nozzle 100*a* from the ink supply port 4 side at the same time as ink is supplied through the nozzle 100*c*.

Further, the communication port 18*a* is provided in the proximity of the ink injection port 86*b* of the second opening 86, so that ink supplied through the nozzle 100*c* is filled through the communication port 18*a*, the communication flow passage 18, the second ink storage chamber 16, and the third ink storage chamber 17 up to the ink supply port 4 as ink mixed with no air (atmosphere).

Next, the ink injection operation in the embodiment will be discussed with reference to FIG. 11. As an ink cartridge, the ink cartridge 1 before the ink supply port 4 is sealed with the film 89 and the first opening 85 and the second opening 86 are sealed (hermetically sealed) with the film 90 is provided.

As shown in FIG. 11, after the nozzles 100*a* to 100*c* of the ink injection machine 100 are connected to the ink supply port 4, the first opening 85, and the second opening 86 (ink injection port 86*b*), ink is injected into the first ink storage chamber 11 through the first opening 85 and ink is injected into the ink end chamber (second ink storage chamber 16, third ink storage chamber 17, etc.,) through the ink injection port 86*b*. At this time, ink is injected into the first ink storage chamber 11 while atmosphere in the first ink storage chamber 11 is discharged from the atmospheric communication port 86*a* (shown in FIG. 10).

When the first ink storage chamber 11 is filled with ink to about 50% of the volume of the first ink storage chamber 11, ink injection through the ink nozzle 100*b* is terminated. Ink is injected into the ink end chamber while vacuum suction (vacuum degree 100%) is conducted through the ink supply port 4. In this case, to prevent remaining bubbles and air mixture, it is desirable that ink should be injected into the ink end chamber to about 100% of the volume thereof. Excessively injected ink may be discharged through the ink supply port 4.

After ink injection using the nozzles 100*a*, 100*b*, and 100*c* is ended, the first opening 85, the second opening 86, and the ink supply port 4 are hermetically sealed. The ink injection operation is now complete.

Thus, in the embodiment, ink injection is executed in the ink tank chamber at a deeper position than the opening of the case (in the vicinity of the through part 301*a*). In this case, in the beginning of injecting ink, the distance between-the ink injection position and the bottom of the ink tank chamber is small, and the height difference between the ink injection position and the ink liquid level is small still after ink is injected (after the ink liquid level rises).

Therefore, air mixing into ink at the ink injection time can be prevented and bubbles can be prevented from occurring in the ink tank chamber. In this case, if ink degassed by a degassing module, etc., is injected, bubbles can be more effectively prevented from occurring when ink is injected. Particularly, this point is preferred for ink easily bubbled.

In the embodiment, the case where the atmosphere filling percentage in the first ink storage chamber 11 is set to 50% has been described, but the invention is not limited to it and the percentage can be changed appropriately in response to injected ink amount.

As seen in the description made above, according to the ink cartridge and the ink injection method thereinto according to the invention, it is possible to prevent air from mixing into ink at the ink injection time, and bubbles can be prevented from occurring in the ink tank chamber.

In addition, two or more intermediate walls 301 parallel to each other and each having a through part 301*a* may be provided so that the intermediate walls 301 partition the first ink storage chamber 11 into three or more space parts 11*a* and 11*b* placed side by side in the ink injection direction. In this case, it is preferable that a tip of the ink injector is moved step by step from the deepest space part during ink injection in accordance with ink level in the first ink storage chamber.

What is claimed is:

1. An ink cartridge for a recording apparatus, comprising a case having an ink tank chamber, and an opening through which ink can be injected into the ink tank chamber, wherein:

an intermediate wall partitioning at least a part of the ink tank chamber into two space parts placed side by side in an ink injection direction is disposed in the ink tank chamber, the intermediate wall having wall parts that extend in a direction substantially perpendicular to the ink injection direction and that define a through part through which ink can be injected, and the wall parts being located in opposing sides of the through part; and the through part permits a tip of an ink injector to be inserted and passed through the through part into a deeper one of the space parts to inject ink allowing the ink level of injected ink to exceed the intermediate wall.

2. The ink cartridge as claimed in claim 1, wherein an atmospheric communication port for discharging air in the ink tank chamber is provided to be adjacent to the opening.

3. The ink cartridge as claimed in claim 1, wherein the through part is disposed on an axis of the opening.

4. The ink cartridge as claimed in any of claims 1 to 3, wherein the through part is a through hole circular or U-shaped in cross-section.

5. The ink cartridge as claimed in claim 1, wherein the wall parts are at least partly continuous to each other.

6. A method of injecting ink into an ink cartridge for a recording apparatus, the ink cartridge comprising: a case having an ink tank chamber, and an opening through which ink can be injected into the ink tank chamber; and an intermediate wall having wall parts that extend in a direction substantially perpendicular to an ink injection direction, that define a through part, and that are located in opposing ends of the through part, being disposed in the case, and partitioning the ink tank chamber into two space parts placed side by side in the injection direction, the method comprising:

injecting ink by inserting a tip of an ink injector into and through the through part to be positioned at a deeper one of the space parts; wherein the ink is injected through the through part into the deeper one of the space parts relative to the opening until the ink level of injected ink exceeds the intermediate wall while minimizing a height between the tip and liquid level of injected ink in the beginning of injecting ink, and then keeping the tip into the injected ink as ink injection proceeds.

7. The method of injecting ink into the ink cartridge as claimed in claim 6, wherein ink is injected while air in the ink tank chamber is discharged.

8. An ink cartridge for a recording apparatus, comprising a case having an ink tank chamber, and an opening through which ink can be injected into the ink tank chamber, wherein:

an intermediate wall partitioning at least a part of the ink tank chamber into two space parts placed side by side in an ink injection direction is disposed in the ink tank chamber, neither space part having an ink absorbing member, and wherein the wall includes a through part through which ink can be injected; and the through part permits a tip of an ink injector to be inserted and passed through the through part into a deeper one of the space parts to inject ink allowing the ink level of injected ink to exceed the intermediate wall.

9. An ink cartridge for a recording apparatus, comprising a case having an ink tank chamber, and an opening through which ink can be injected into the ink tank chamber, wherein:

an intermediate wall partitioning at least a part of the ink tank chamber into two space parts placed side by side in an ink injection direction is disposed in the ink tank chamber, and the intermediate wall extends in a direction substantially perpendicular to the ink injection direction and includes, at an intermediary portion of the intermediate wall in the extending direction, a through part through which ink can be injected; and the through part permits a tip of an ink injector to be inserted and passed through the through part into a deeper one of the space parts to inject ink allowing the ink level of injected ink to exceed the intermediate wall.

10. A method of injecting ink into an ink cartridge for a recording apparatus, the ink cartridge comprising: a case having an ink tank chamber, and an opening through which ink can be injected into the ink tank chamber; and an intermediate wall that extends in a direction substantially perpendicular to an ink injection direction, and that includes a through part through which ink can be injected, being disposed in the case, and partitioning the ink tank chamber into two space parts placed side by side in the injection direction, the through part being formed at an intermediary portion of the intermediate wall in the extending direction, the method comprising:

injecting ink by passing a tip of an ink injector into and through the through part into a deeper one of the space parts; wherein the ink is injected through the through part into the deeper one of the space parts relative to the opening until the ink level of injected ink exceeds the intermediate wall.

11. An ink cartridge for a recording apparatus, comprising:

a case having an ink tank chamber;

an opening through which ink can be injected into the ink tank chamber;

an ink supply port disposed on the case; and a differential pressure valve that is disposed between the ink supply port and the ink tank chamber, the differential pressure valve operable to selectively open in response to a pressure change of ink at the ink supply port, wherein:

an intermediate wall partitioning at least a part of the ink tank chamber into two space parts placed side by side in an ink injection direction is disposed in the ink tank chamber, and is formed with a through part through which ink can be injected; and the through part permits a tip of an ink injector to be inserted and passed through the through part into a deeper one of the space parts.

12. The ink cartridge as claimed in claim 11, wherein the through part permits the tip of the ink injector to inject ink until the ink level of injected ink exceeds the intermediate wall.

13. A method of injecting ink into an ink cartridge for a recording apparatus, the ink cartridge comprising: a case having an ink tank chamber, and an opening through which ink can be injected into the ink tank chamber; and an intermediate wall having wall parts that extend in a direction substantially perpendicular to an ink injection direction, that define a through part, and that are located in opposing ends of the through part, being disposed in the case, and partitioning the ink tank chamber into two space parts placed side by side in the injection direction, the method comprising:

injecting ink by a tip of an ink injector through the through part into a deeper one of the space parts relative to the opening until the ink level of injected ink exceeds the intermediate wall, wherein the ink is injected while air in the ink tank chamber is discharged.

14. A method of injecting ink into an ink cartridge for a recording apparatus, the ink cartridge comprising: a case having an ink tank chamber, and an opening through which ink can be injected into the ink tank chamber; and an intermediate wall having wall parts that extend in a direction substantially perpendicular to an ink injection direction, that define a through part, and that are located in opposing ends of the through part, being disposed in the case, and partitioning the ink tank chamber into two space parts placed side by side in the injection direction, the method comprising:

inserting a tip of an ink injector into and through the through part to be positioned at a deeper one of the space parts; wherein the ink is injected through the through part into the deeper one of the space parts relative to the opening until the ink level of injected ink exceeds the intermediate wall.

* * * * *